US007578757B1

(12) United States Patent
McNary

(10) Patent No.: US 7,578,757 B1
(45) Date of Patent: Aug. 25, 2009

(54) PUCK-DEFLECTING TRAINING DEVICE WITH VERTICAL AND HORIZONTAL DEFLECTING MEMBERS AND METHOD

(76) Inventor: David F. McNary, 12 Shields St., Woburn, MA (US) 01801

( * ) Notice: Subject to any disclaimer, the term of this patent is extended or adjusted under 35 U.S.C. 154(b) by 361 days.

(21) Appl. No.: 11/484,496

(22) Filed: Jul. 11, 2006

Related U.S. Application Data

(63) Continuation-in-part of application No. 10/763,960, filed on Jan. 26, 2004, now Pat. No. 7,074,140.

(51) Int. Cl.
*A63B 69/00* (2006.01)

(52) U.S. Cl. ..... 473/446; 273/400

(58) Field of Classification Search ..... 473/446; 273/400; 256/28, 24, 21; 160/328; D25/121
See application file for complete search history.

(56) References Cited

U.S. PATENT DOCUMENTS 963,447 A * 7/1910 Leonard ..... 160/328
1,491,029 A * 4/1924 Carter ..... 160/328
1,643,297 A * 9/1927 Fitch et al. ..... 160/328
2,812,814 A * 11/1957 Fogh ..... 160/328
4,039,189 A * 8/1977 Headrick et al. ..... 273/400
4,647,016 A * 3/1987 Doublet ..... 256/24
4,809,988 A * 3/1989 Hunter ..... 273/400
5,580,064 A * 12/1996 Childers, Jr. ..... 273/400
5,893,563 A * 4/1999 Buller ..... 273/400
5,902,194 A * 5/1999 Wade ..... 473/446
7,074,140 B1 * 7/2006 McNary ..... 473/446

* cited by examiner

*Primary Examiner*—Gene Kim
*Assistant Examiner*—M Chambers
(74) *Attorney, Agent, or Firm*—William Nitkin

(57) ABSTRACT

An ice hockey training device providing goalie training in preventing pucks, particularly deflected or "tipped" pucks, from entering the goal is disclosed. The device is disposed on ice or other playing surface in front of a goal guarded by a goalie, the device having a plurality of vertically disposed puck deflectors arrayed in a parallel series through which array the puck is shot at the goal by a player and strikes a puck deflector member to be deflected at an angle from its original path of travel. A plurality of horizontally disposed members are suspended behind the vertically disposed puck deflector members.

1 Claim, 4 Drawing Sheets

PUCK-DEFLECTING TRAINING DEVICE WITH VERTICAL AND HORIZONTAL DEFLECTING MEMBERS AND METHOD

This application is a continuation-in-part of my prior application entitled Puck-deflecting Training Device filed Jan. 26, 2004 Ser. No. 10/763,960, now U.S. Pat. No. 7,074,140.

BACKGROUND OF THE INVENTION

1. Field of the Invention

The structure and method of this invention reside in the area of sporting equipment and more particularly relate to a training device for use by ice hockey goalies which device, when in use, causes deflections of pucks hit at short range and provides goalie training in preventing deflected or "tipped" pucks from entering the goal and its method of use.

2. History of the Prior Art

A hockey goalie stands in the crease in front of a hockey goal and attempts to stop pucks from entering the goal that are shot at the goal by members of the opposing team. The puck can be shot at the goal by members of the opposing team from a distance, at very close range or the puck can be shot or passed from one player to another and then shot at the goal, giving the goalie very little time to react to the puck's change in direction of movement. The puck can also be tipped, or deflected off the hockey stick blade, on its way toward the goal by a second player from a first player's shot, resulting in a different angle of puck movement toward the goal. Such tipped shots are more difficult for a goalie to catch or prevent from entering the goal because there is less time to gauge the direction of movement of the puck.

SUMMARY OF THE INVENTION

It is an object of the device of this invention, hereinafter referred to as a tip trainer, to duplicate the tipping deflections of pucks that frequently occur in actual ice hockey games for use by goalies during team practice and training sessions.

It is a further object of this invention to cause deflection of a puck near the goalie that is shot by a player at a distance from the goal so that the goalie can practice trying to stop or catch a puck that is deflected, or tipped, before coming into the goalie's vicinity.

It is a still further object of this invention to provide a device that will deflect the path of movement of pucks traveling in the air above the ice.

It is yet a further object of this invention to provide a training device that is easy to ship, easy to assemble and easily maneuverable on the ice of an ice hockey rink or on a rink with synthetic "ice" such as plastic playing surfaces or equivalent. It should be understood that all references made to ice herein include such equivalent playing surfaces.

The device of this invention consists of a movable support framework having a top member from which a plurality of puck deflector members hang vertically therefrom arrayed parallel to one another. The device can be placed at a desired distance in front of a hockey goal during a practice session. The device in one embodiment can be placed between 6-12 feet in front of the goal. In use, a single player can shoot a puck at the device of this invention in front of the goal; and the puck, if it strikes one of the puck deflector members, will be deflected at an angle from its original path direction, such angle determined by the manner in which the puck strikes a puck deflector member, thus increasing the difficulty for the goalie in preventing the puck from entering the goal. This increased in difficulty in gauging the path of the deflected puck is desirable for providing specialized practice training to a goalie.

The framework of this invention consists of first and second upright members which are supported, respectively, on first and second support members with a top member extending between the tops of the first and second upright members. A plurality of puck deflector members hang downward from the top member, and a series of puck deflectors are suspended horizontally in rows behind the vertically disposed puck deflector members. These puck deflector members in one embodiment can be in the form of a plurality of vertically hanging chains spaced apart from one another a specific distance, such as 4-5 inches apart and a series of horizontally suspended chains disposed behind the vertically disposed chains, such that when a player shoots a puck moving above the ice through the hanging puck deflector members, the puck will frequently strike one of the puck deflector members and be deflected from its original path toward the goal area. The horizontal chains prevent the vertical chains from being forced rearwardly too much to avoid chain entanglement and to allow the device to return to its proper position for the next shot. Pucks are about 3 inches in diameter and only occasionally will they pass between a pair of adjacent puck deflector members that are approximately 4 inches apart from one another. This occasionally passing through shot without deflection helps keep the goalie guessing as to the puck's ultimate direction of travel.

DESCRIPTION OF THE PREFERRED EMBODIMENT(S)

Figure 1:
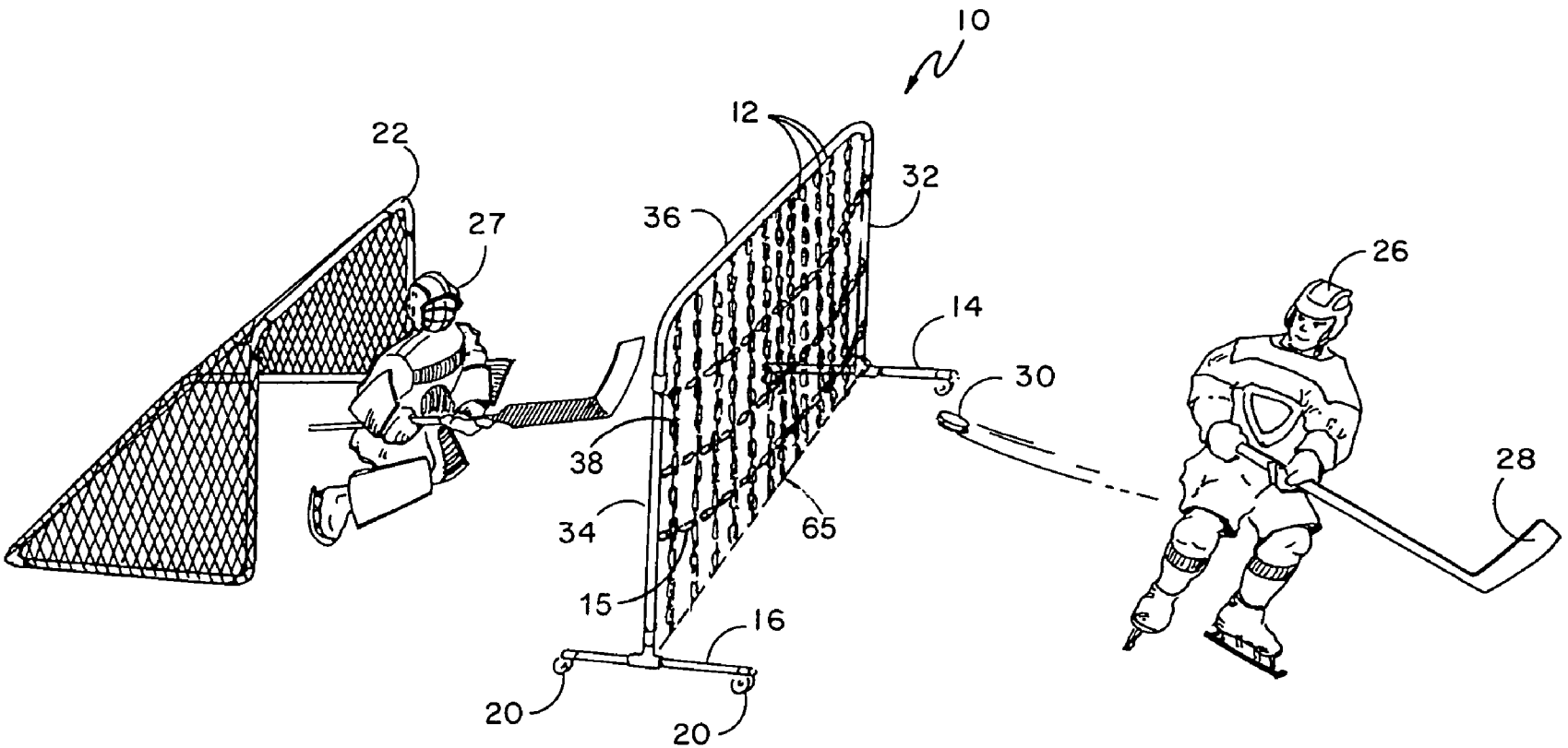
FIG. 1 illustrates a side perspective view of the tip training device of this invention disposed between a hockey player and a goal with a goalie positioned in front of the goal.
Figure 2:
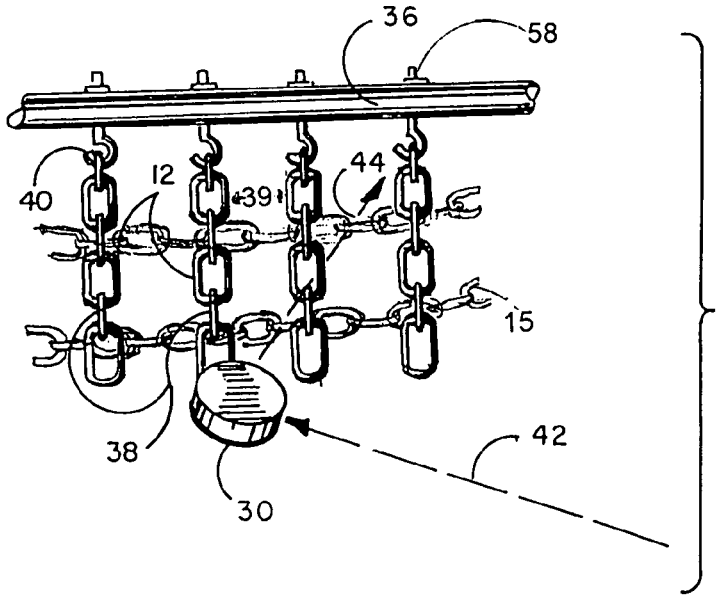
FIG. 2 illustrates an enlarged sectional view of a portion of the top member of the tip trainer showing a plurality of puck deflector members hanging therefrom, and showing the path of a puck traveling along a first path, then striking a puck deflector member, causing it to be deflected onto a second path.

FIG. 1 illustrates a side perspective view showing tip trainer 10 disposed in front of goalie 27 who is standing in front of hockey goal 22. Player 26 shoots puck 30 with hockey stick 28 such that the puck, as it passes through tip trainer 10, in most instances will come in contact with at least one of a plurality of vertically disposed puck deflector members 12 or horizontally disposed members 15 which in the embodiment shown in the enlarged view of FIG. 2, can be a plurality of vertically disposed hanging chains 38. As seen in FIG. 2 puck 30 travels along first path 42 from the point where it is first struck by a player's hockey stick. Puck 30 then strikes one of the puck deflector members 12 which, in the embodiment illustrated, are chains 38, and is then deflected from its original first path 42 to a second path 44 at an angle where goalie 27, who is positioned in front of the goal behind tip trainer 10, must then try to catch or block the deflected puck from entering the goal. Having little time to observe the puck's new direction of travel, the goalie must be constantly alert and must exercise quick reflexes to catch or block the deflected puck from entering the goal. While in a preferred embodiment the plurality of chains 38 can be provided in ⅜ inch or 5/16 inch sizes, it should be noted that the present invention is not limited to chains alone and that other materials for the puck deflector members can also be utilized, such as a plurality of heavy ropes, cables, wires, etc. Chains 38, as seen in FIG. 2, can be attached to top member 36 by eye bolts 40 which pass through spaced-apart apertures defined in top member 36; and nuts 58 can be tightened on the opposite end of eye bolts 40 to retain them in position. Other means of attachment can also be utilized. Puck deflector members 12, such as chains 38, can extend downward approximately 46 inches toward the ice. The spacing 39 between two adjacent puck deflector members can, in a preferred embodiment, be approximately 4½ inches although other spacings can accomplish the objects of this invention. However, if they are spaced too widely apart from one another, pucks might too easily pass between two puck deflector members without enough striking one of them sufficiently for deflection purposes. In some embodiments connection member 65, as seen in FIGS. 1 and 4, can be a rope or cable passing through the aperture in the bottom link of each chain or otherwise be attached to the bottom of each vertically disposed puck deflector member such as by tying to help retain the vertically disposed puck deflector members in position when struck by a puck which attachment helps prevent their moving around too much when struck by the puck. A series of horizontally disposed chain members 15, as seen in FIGS. 1, 2 and 4, can be suspended behind vertically disposed puck deflector members 12. Horizontal chain members 15 are disposed behind puck deflector members 12 on the other side from player 26. In addition to occasionally deflecting a puck, they help prevent puck deflector members 12 from moving rearward to too great a degree when struck by a puck and to prevent entanglement and disruption to tip trainer 10. When using horizontal chain members 15, the individual puck deflector members are not deflected to too great a degree rearwards and the entire structure of the unit is more stabilized. Such horizontal chain members 15, as seen in FIG. 3, can be attached to eye bolts 40 and tightened in place by nuts 58 which horizontal chain members 15 are attached to first upright member 32 by hooks disposed at each end of the horizontal chain members 15.

Figure 3:
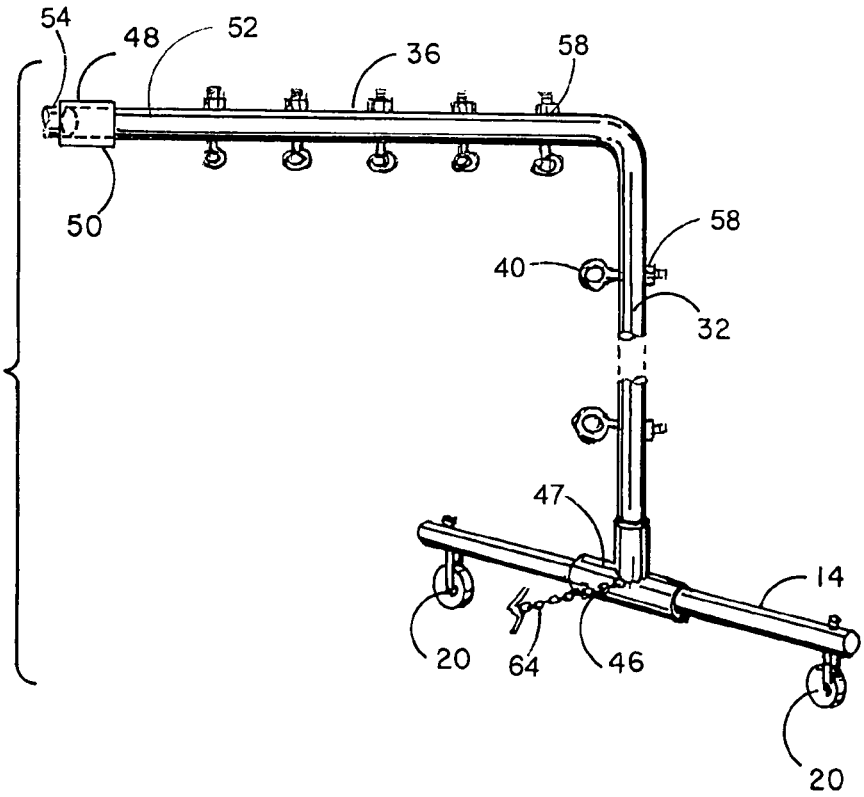
FIG. 3 illustrates a perspective view of a section of the framework with the top member being divided into a first and second portion that are joined together and being supported at one end on a first upright member which has at the bottom thereof a T-member receiving the second end of the first upright member.
Figure 4:
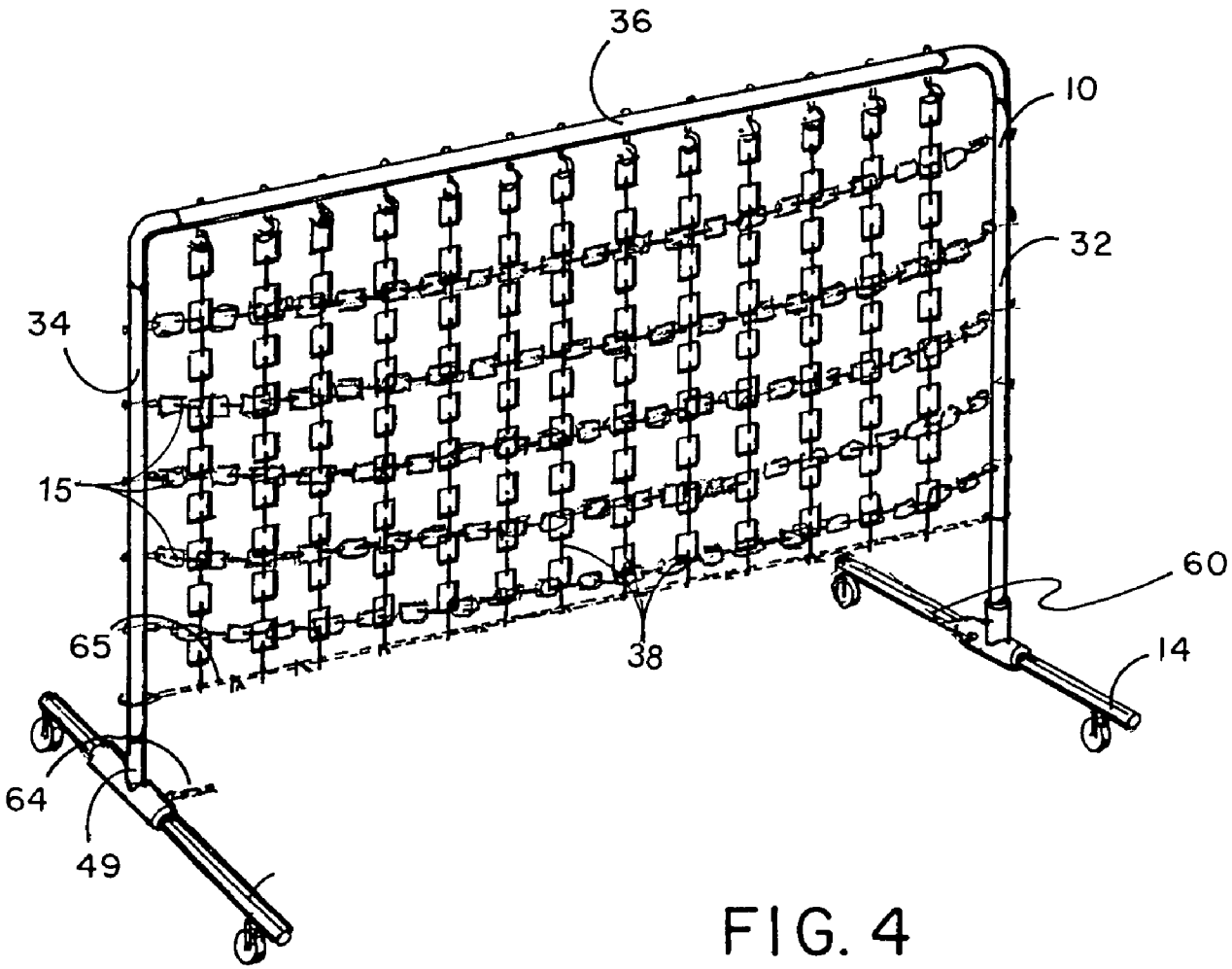
FIG. 4 illustrates a perspective view of the embodiment of the tip trainer showing a plurality of vertical and horizontal chains.

FIG. 3 illustrates one-half of the framework of the device of this invention wherein top member 36 is composed of two parts: a first portion 52 and a second portion 54. Second portion 54 has a receipt member 48 defined at the end thereof into which insertion portion 50 shown in dashed lines of first portion 52 of top member 36 is inserted and attached with a screw or other tightening means, not shown. By having top member 36 provided in two parts, the device of this invention can be easily shipped in a disassembled state. The top member, when assembled, can be in one embodiment approximately 84 inches in length. The top member can then be attached to, or integrally formed with, downwardly extending first upright member 32 and attached to first support member 14 which structure is matched by an opposite second upright member 34 and second support member 16, as seen in FIG. 1. The first and second upright members can each be approximately 48-50 inches in height. First support member 14 can be easily affixed to first upright member 32 by attaching a first T member 46 to the bottom of first upright member 32 wherein receipt area 47 of the first T member forms an aperture through which first support member 14 can easily pass during assembly and be tightened in place by a set screw and the like. The framework can be constructed of metal, plastic, wood or equivalent sturdy material. At each end of each support member can be wheels, such as wheels 20, so that tip trainer 10 can be moved about on the ice to a desired position. The overall weight of the tip trainer hampers movement of the device during training sessions.

FIG. 4 illustrates a perspective view of the device of this invention wherein the plurality of horizontally disposed chain members 15 are suspended behind the vertically disposed hanging chain members 38. In some embodiments connection member 65, as seen in FIG. 4, is attached to first and second upright members 32 and 34 to prevent them from spreading apart and to hold the bottom of hanging chains 38.

Figure 5:
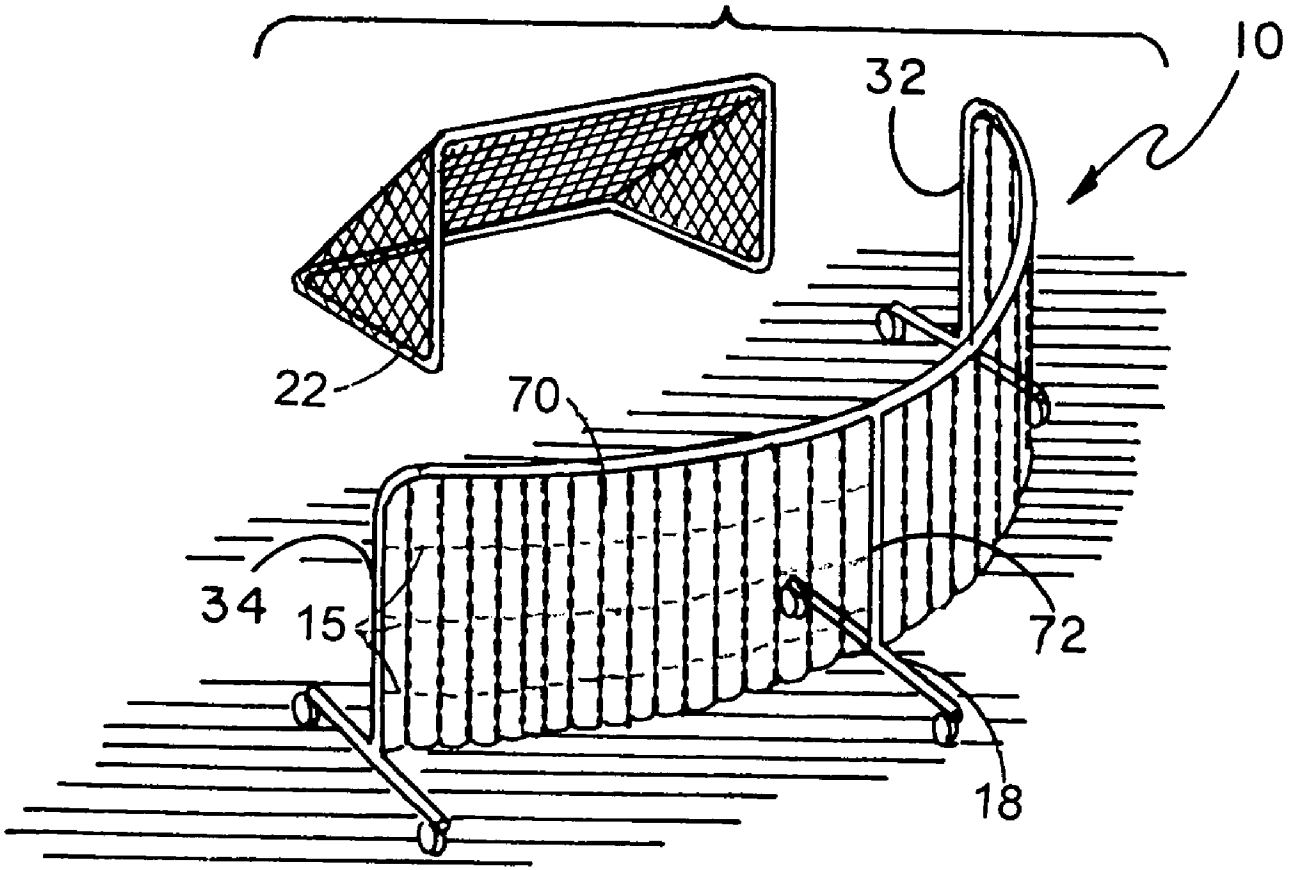
FIG. 5 illustrates a perspective view of the embodiment of the tip trainer having a curved top member.

FIG. 5 illustrates an embodiment of tip trainer 10 having a curved top member 70 which structure can be advantageous for utilization during training sessions when hockey players are shooting pucks at various angles from positions other than directly in front of the goal. Curved top member 70 can be positioned approximately 7 feet in front of the goal and in some embodiments can extend as much as 180 degrees to form half a circle having a diameter of approximately 14 feet around the front of the hockey goal crease so that a puck striking the tip trainer of this embodiment from a wide angle in front of the tip trainer can be deflected in most instances by a vertically disposed, hanging puck deflector members, as provided in the tip trainer of this invention. When using a tip trainer having a curved top member 70, a third upright member 72 and its related third support member 18 can be utilized to help support this embodiment of the tip trainer. When using a curved top member, horizontal chain members can also be suspended behind the vertically disposed chain members and are especially helpful if they are attached to the third support member in the center thereof so that they are positioned as much as possible directly behind the vertically hanging chain members.

Although the present invention has been described with reference to particular embodiments, it will be apparent to those skilled in the art that variations and modifications can be substituted therefor without departing from the principles and spirit of the invention.

I claim:

1. An ice hockey training device for a goalie for use on ice, said device disposed in front of said hockey goal with said goalie positioned between said device and said hockey goal, comprising in combination with said hockey goal:

a framework having a first side and a second side, said framework disposed 6-12 feet in front of said hockey goal and said first side of said framework, said framework having a top member, said top member having a first end, a second end, and a length;

first and second upright members, each of said first and second upright members having a first end, a second end and a length, said first ends of said first and second upright member supporting, respectively, said first end and said second end of said top member;

first and second support members, said first and second support members having engagement means for engaging, respectively, said second end of said first upright member and said second end of said second upright member;

a plurality of vertically disposed flexible elongated puck deflector members selected from the group of chains, cables, ropes and wires, said vertically disposed puck deflector members arrayed in a parallel series spaced approximately 4½ inches apart from one another hanging from said framework, each of said vertically disposed puck deflector members having a first end and a second end, said first ends of each of said vertically disposed puck deflector members attached to said top member and hanging downward therefrom toward said ice, said plurality of vertically disposed puck deflector members for being struck by said hockey puck and for deflection of said hockey puck shot from said second side of said training device through said plurality of vertically disposed puck deflector members for changing the direction of movement of said hockey puck close to said goalie to make it more difficult for said goalie to catch or deflect said hockey puck;

said plurality of vertically disposed puck deflector members causing a hockey puck striking one of said vertically disposed puck deflector members at a first direction of movement to be deflected and to continue traveling toward said hockey goal and said goalie at a second direction of movement; and a plurality of horizontally disposed puck deflector members selected from the group of chains, cables, ropes and wires, said horizontally disposed puck deflector members arranged in a series immediately behind said vertically disposed puck deflector members for limiting the amount of deflection of said vertically disposed puck deflector members as they are forced rearward by said hockey puck, thus avoiding vertically disposed puck deflector member entanglements, said horizontally disposed puck deflector members having first and second ends attached, respectively, to said first and second upright members of said framework;

wherein when placing said ice hockey training device in front of said goalie and shooting a hockey puck toward said hockey goal on a first path of travel to strike one of said puck deflector members, said hockey puck is deflected from its first path of travel to a second path of travel for making it more difficult for said goalie to catch or stop said hockey puck from entering said hockey goal and including a connection member extending from said first upright member to said second upright member for interconnecting said second ends of said vertically disposed puck deflector members.

* * * * *